United States Patent [19]

Takamatsu et al.

[11] Patent Number: 5,033,436

[45] Date of Patent: Jul. 23, 1991

[54] FUEL CONTROL SYSTEM FOR AUTOMOBILE ENGINE

[75] Inventors: Hiroshi Takamatsu; Hiromasa Ishino, both of Hiroshima, Japan

[73] Assignee: Mazda Motor Corporation, Hiroshima, Japan

[21] Appl. No.: 549,565

[22] Filed: Jul. 9, 1990

[30] Foreign Application Priority Data

Jul. 7, 1989 [JP] Japan ..... 1-174078

[51] Int. Cl.[5] ..... F02M 51/00

[52] U.S. Cl. ..... 123/478; 123/492

[58] Field of Search ..... 123/478, 492, 489, 440

[56] References Cited

U.S. PATENT DOCUMENTS

| | | | |
|---|---|---|---|
| 4,488,529 | 12/1984 | Nishida et al. | 123/489 |
| 4,561,403 | 12/1985 | Oyama et al. | 123/489 |
| 4,763,629 | 8/1988 | Okazaki et al. | 123/489 |
| 4,877,006 | 10/1989 | Norton et al. | 123/489 |
| 4,913,120 | 4/1990 | Fujimoto et al. | 123/489 |
| 4,936,278 | 6/1990 | Umeda | 123/489 |

FOREIGN PATENT DOCUMENTS

| | | | |
|---|---|---|---|
| 53-8427 | 1/1978 | Japan | 123/478 |

*Primary Examiner*—Raymond A. Nelli

*Attorney, Agent, or Firm*—Fleit, Jacobson, Cohn, Price, Holman & Stern

[57] ABSTRACT

A fuel control system for an internal combustion engine of an automotive vehicle controls an air-fuel ratio using feedback so as to determine a proper air-fuel ratio by constantly monitoring the exhaust to verify the accuracy of an air-fuel mixture setting. The fuel control system halts the feedback fuel control and forcibly causes an increase of fuel so as to enrich an air-fuel mixture setting when an engine operating condition shifts into a specific zone of engine load in which the engine operates at high loads. The forced increase of fuel is delayed for a predetermined time period when the engine operates at speeds within a specific speed zone in the specific load zone, the time period being changed so as to be longer or shorter according to engine speeds in the specific speed zone.

12 Claims, 3 Drawing Sheets

FUEL CONTROL SYSTEM FOR AUTOMOBILE ENGINE

FIELD OF THE INVENTION

The present invention relates to an automobile engine fuel control system, and more particularly, to a fuel injection control system for an automobile engine which, in a specific range of engine operation conditions, increasingly varies the amount of fuel to be delivered into an automobile engine.

BACKGROUND OF THE INVENTION

A closed loop or feedback fuel injection control system determines a proper air-fuel ratio and constantly monitors the exhaust to verify the accuracy of the air-fuel mixture setting. When an exhaust sensor detects no oxygen content in engine exhaust, the feedback fuel injection control system undergoes a procedure to maintain an ideally combustible air-to-fuel ratio, namely a stoichiometric air-fuel mixture, by correcting itself so as to bring the oxygen concentration back to proper levels. Since the feedback fuel injection control system tries to maintain the air-fuel mixture setting even during acceleration, which requires high engine power, the engine can not provide a desired, or sufficient power under highly loaded engine operating conditions if the feedback fuel injection control takes place over the entire zone of engine operating conditions. For this reason, the feedback fuel injection control system is usually designed to interrupt or halt the feedback fuel injection control in a specific engine operating condition zone in which the engine operates with high load and, in a specific zone (which is referred to as a high-load forced fuel increase zone), an intentionally increased amount of fuel is forcibly delivered.

Typically, since such a forced fuel increase control is conducted for only a short time period immediately after every change of an engine operating condition from the feedback fuel control zone to the high-load forced fuel increase zone, the engine is apt to be subjected to a decrease in fuel economy, or mileage.

To eliminate such a decrease in fuel mileage, some fuel control systems are designed to halt fuel increase control for a predetermined time period (which is hereinafter referred to as a fuel injection delay time) after the change of an engine operating condition from the feedback control zone to the high-load forced fuel increase zone. Such a fuel control system is known from, for instance, Japanese Patent Application No. 51-83181, entitled "Air-Fuel Ratio Feedback Control System For Internal Combustion Engine," filed on July 12, 1976, and laid open as Japanese Unexamined Patent Publication No. 53-8427, on Jan. 25, 1978.

However, the fuel control system described in the above publication encounters the problem that because the interruption or halt of forced fuel increase takes place even when an engine operating condition changes from a low speed operating condition to a high-speed, high-load operating condition and, accordingly, instantaneously requires a very rapid power increase during, for instance, a quick acceleration, the engine its running ability is temporarily deteriorated.

SUMMARY OF THE INVENTION

It is, therefore, a primary object of the present invention to provide a fuel control system which prevents an engine from deteriorating in its running ability.

It is another object of the present invention to provide a fuel economy, or control system which prevents an engine from lowering fuel mileage. The object of the present invention is achieved by providing a fuel injection control system for an internal combustion engine of an automotive vehicle feedback which performs fuel injection in feedback control so as to determine a proper airfuel ratio by constantly monitoring exhaust to verify the accuracy of an air-fuel mixture setting. When an engine operating condition of the engine shifts into a specific zone of engine load, wherein the engine operates with high loads or the engine is required to provide a very rapid power increase or "power up", the feedback fuel control is halted and a forced increase in the amount of fuel is conducted so as to enrich the air-fuel mixture.

When an engine operating condition changes to speeds within a specific speed zone while shifting into the specific load zone, the forced increase of fuel is delayed for a predetermined time period, which is changeable according to engine operating speeds. The time period is changed so as to be shorter at low speeds in the specific speed zone than at high speeds in the specific speed zone. In a preferred embodiment, the specific speed zone is divided into two sub-zones, i.e., low and high engine speed sub-zones, for instance. The low and high engine speed sub-zones may be, for example, under 1,000 rpm and under 4,000 rpm, respectively, so that the time period is changed to a short time period, for instance approximately two to three seconds, at speeds in the low engine speed sub-zone and a long time period, for instance approximately ten seconds, at speeds in the high engine speed sub-zone. However, when the internal combustion engine an operating speed to speeds out of the specific zone of engine speed while shifting into said specific zone of engine load, the forced increase of fuel is caused without any time delay.

BRIEF DESCRIPTION OF THE DRAWINGS

Still other objects of the invention and more specific features will become apparent to those skilled in the art from the following description of the preferred embodiment when considered together with the accompanying drawings, wherein like reference characters have been used in the different figures to denote the same parts, and in which.

DESCRIPTION OF THE PREFERRED EMBODIMENT

Because in general, vehicle engines are well known, the present description will be directed to particular elements forming parts of, or cooperating directly with, the system in accordance with the present invention. It is to be understood that elements not specifically shown or described can take various forms well known to those skilled in the automobile engine art.

Figure 1:
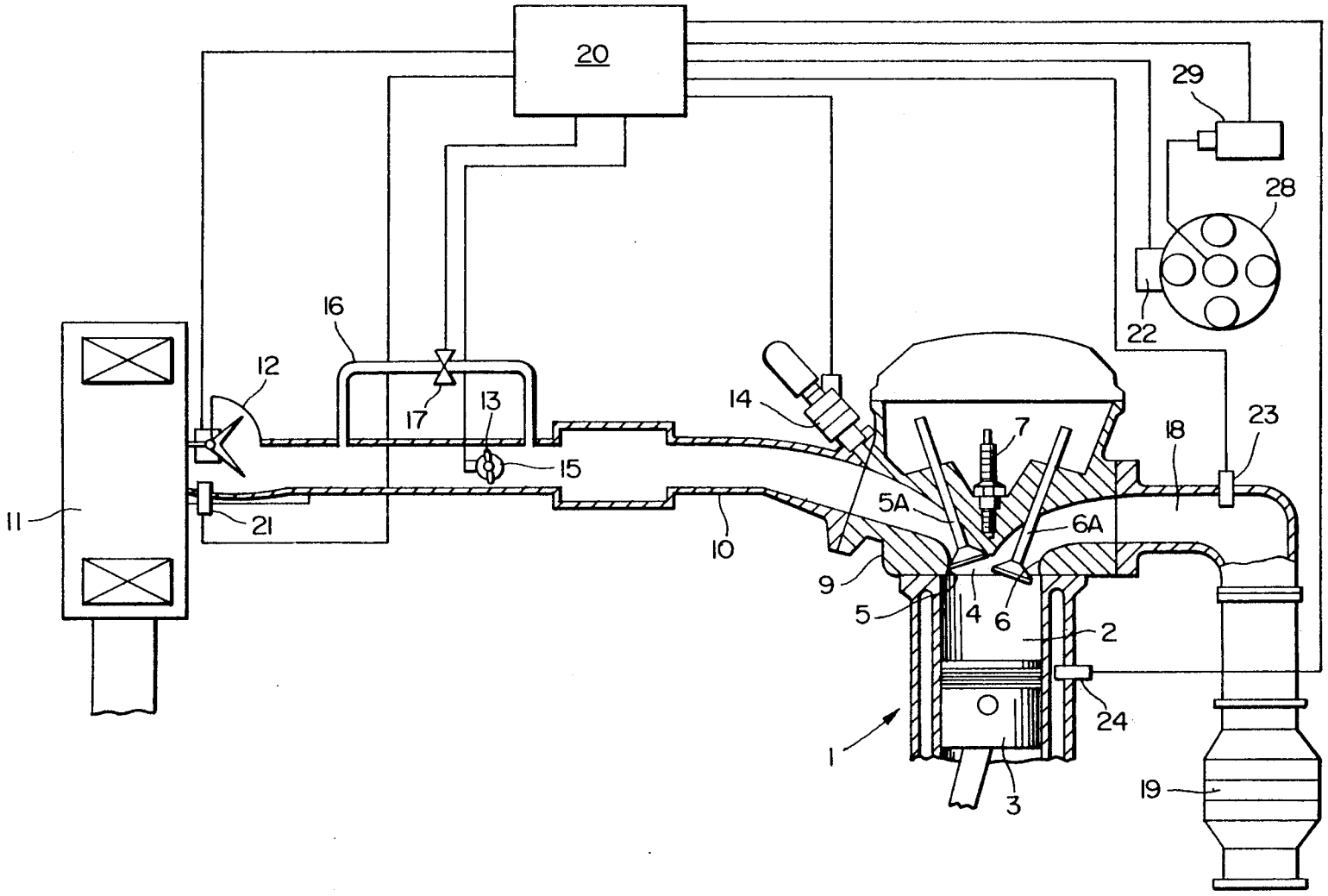
FIG. 1 is a schematic illustration showing an automobile engine with a fuel control system in accordance with a preferred embodiment of the present invention.

Referring to the drawings in detail, and particularly to FIG. 1, an automobile engine having an intake system in accordance with a preferred embodiment of the present invention is shown. The automobile engine has an engine block 1 formed with a cylinder 2 slidably receiving a piston 3. A combustion chamber 4 is formed between the cylinder 2 and piston 3. A cylinder head 9, mounted on the engine block 1, is formed with intake and exhaust ports 5 and 6 opening to the combustion chamber 4. In the cylinder head 9 are disposed intake and exhaust valves 5A and 6A seated in the intake and exhaust ports 5 and 6, respectively. These intake and exhaust valves 5A and 6A are timely, or sequentially driven by a valve train (well known in the art and not shown in FIG. 1) to open and close the intake and exhaust ports 5 and 6. A spark plug 7 is threaded into the cylinder head 9 at the top of the combustion chamber 4. A firing system for the spark plug 7 comprises a distributor 28 and a igniter 29. The distributor 28 is provided with an angle sensor 22 to detect the turned angle of a distributor shaft and produce an appropriate signal representative of the turned angle. The firing system may be of any type well known in the art.

The combustion chamber 4 is in communication with intake and exhaust manifolds 10 and 18. The intake manifold 10, connecting an air cleaner 11 to the combustion chamber 4, is provided with an air-flow meter 12 disposed adjacent to the air cleaner for detecting the amount of intake air, i.e., the rate at which air flows into manifold 10. The intake manifold 10 is further provided with a throttle valve 13 located after, or downstream of, the air-flow meter 12 for controlling the quantity of air reaching the combustion chamber 4. A fuel injector 14 is disposed adjacent to the intake port 5 for injecting a controlled quantity of fuel into the combustion chamber 4. Close to the air-flow meter 12, an intake air temperature sensor 21 is provided to detect the temperature of intake air taken into the intake manifold 10 through the air cleaner 11 and provide an appropriate output signal representative of the air temperature detected thereby. In association with the throttle valve 13, a throttle opening sensor 15, having therein an idle switch which is kept turned on when the engine is idling, is provided to detect an opening of the throttle valve 13 and produce an appropriate output signal representative of the opening of the throttle valve 13. The intake manifold 10 is formed with a bypass passage pipe 16 with an electromagnetically actuated idle speed control valve 17, which is well known and typically referred to as an "ISC valve," to allow and regulate the flow of air therethrough. The air flowing through bypass passage pipe 16 bypasses the throttle valve 13, so as to supply supplementary air into the intake manifold 10 downstream of the throttle valve 13.

The exhaust manifold 18, connecting the combustion chamber 4 to a catalytic converter 19 for significantly lowering emission levels of hydrocarbons, carbon monoxide, and in the cases of some converters, oxides of nitrogen, as is well known in the art, is provided with an oxygen sensor 23 near the exhaust port 6 to detect oxygen and produce an appropriate output signal representative of the oxygen content of the emissions. The engine block 1 is provided with a temperature sensor 24 to detect the temperature of engine coolant and produce an appropriate output signal representative of the coolant temperature. All of these output signals provided from the meter 12 and sensors 15, 21, 22, 23 and 24 are sent to a control unit 20, comprising a microcomputer. The control unit 20 provides the ISC valve 17 and the igniter 29 with control signals and adjusts the pulse width of a signal to be applied to the fuel injector 14 so as to deliver a correct air-fuel ratio for any given engine demand. The pulse width T is calculated according to the following formula:

$$T = Tp \times (1 + Cfb + Cer + C) + Tv \ldots (I)$$

where

Tp is a basic pulse width determined according to an engine speed;

Cfb is a correction value in feedback fuel injection control;

Cer is a predetermined fuel increase value for a high-load engine demand;

C is a general correction value based on, for instance, the temperature of engine coolant; and Tv is a pulse width for compensatory fuel injection. Considering Q, Ne and K to represent a quantity of intake air, an engine speed and an invariable, or constant, respectively, the basic pulse width Tp of the above formula (I) is given as follows:

$$Tp = Q/Ne \times K$$

Figure 2:
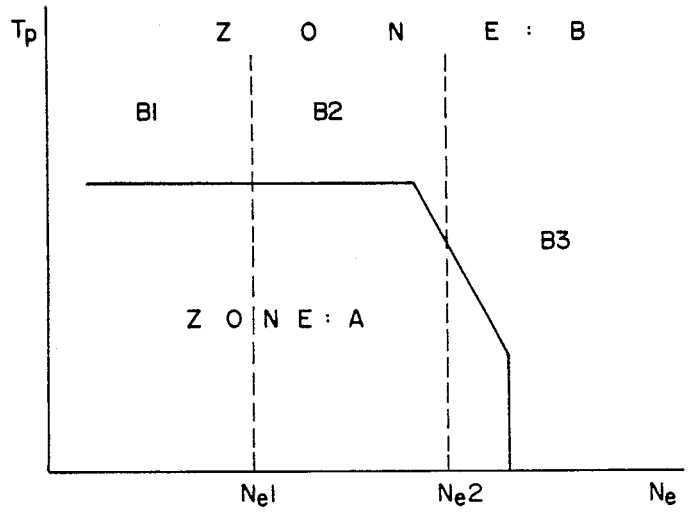
FIG. 2 is a diagram showing fuel control zones.

FIG. 2 shows a fuel injection control pattern or map for the fuel injection control system according to the preferred embodiment of the present invention for a feedback fuel control for low-load engine demands, this control being hereinafter referred to as a low-load fuel feedback control, and a forced fuel increase control for high-load engine demands, this control being hereinafter referred to as a high-load forced fuel increase control. In FIG. 2, the y axis of the diagram represents the basic pulse width Tp of a signal applied to fuel injector 14, which determines the amount of fuel injected, and the x axis of the diagram represents the speed of engine Ne. In FIG. 2, engine operating conditions are generally divided into two control zones A and B (including B1, B2 and B3) for different fuel injection controls, namely the low-load fuel feedback control and the high-load forced fuel increase control. The forced fuel increase control zone B is further divided into three divisional zones B1, B2 and B3 according to specific engine speeds Ne1 and Ne2, for a short time delayed fuel increase control, a long time delayed fuel increase control and a real time fuel increase control, respectively. These engine speeds Ne1 and Ne2 are specifically predetermined to be, for instance, 1,000 rpm and 4,000 rpm, respectively. The fuel injection delay time is set to a time t1, for instance about 2 to 3 seconds, when the engine operating condition changes to the low engine speed divisional zone B1 from the fuel feedback control zone A, or to a time t2, for instance about 10 seconds, which is longer than the time t1, when the engine operating condition changes to the high engine speed divisional zone B2 from the fuel feedback control zone A. However, in the divisional zone B3, the fuel injection delay time is set to zero. This means that a fuel increase control is performed as soon as the engine operating condition falls into the divisional zone B3. A map representing these fuel control zones is stored in the microcomputer of the control unit 20.

Figure 3:
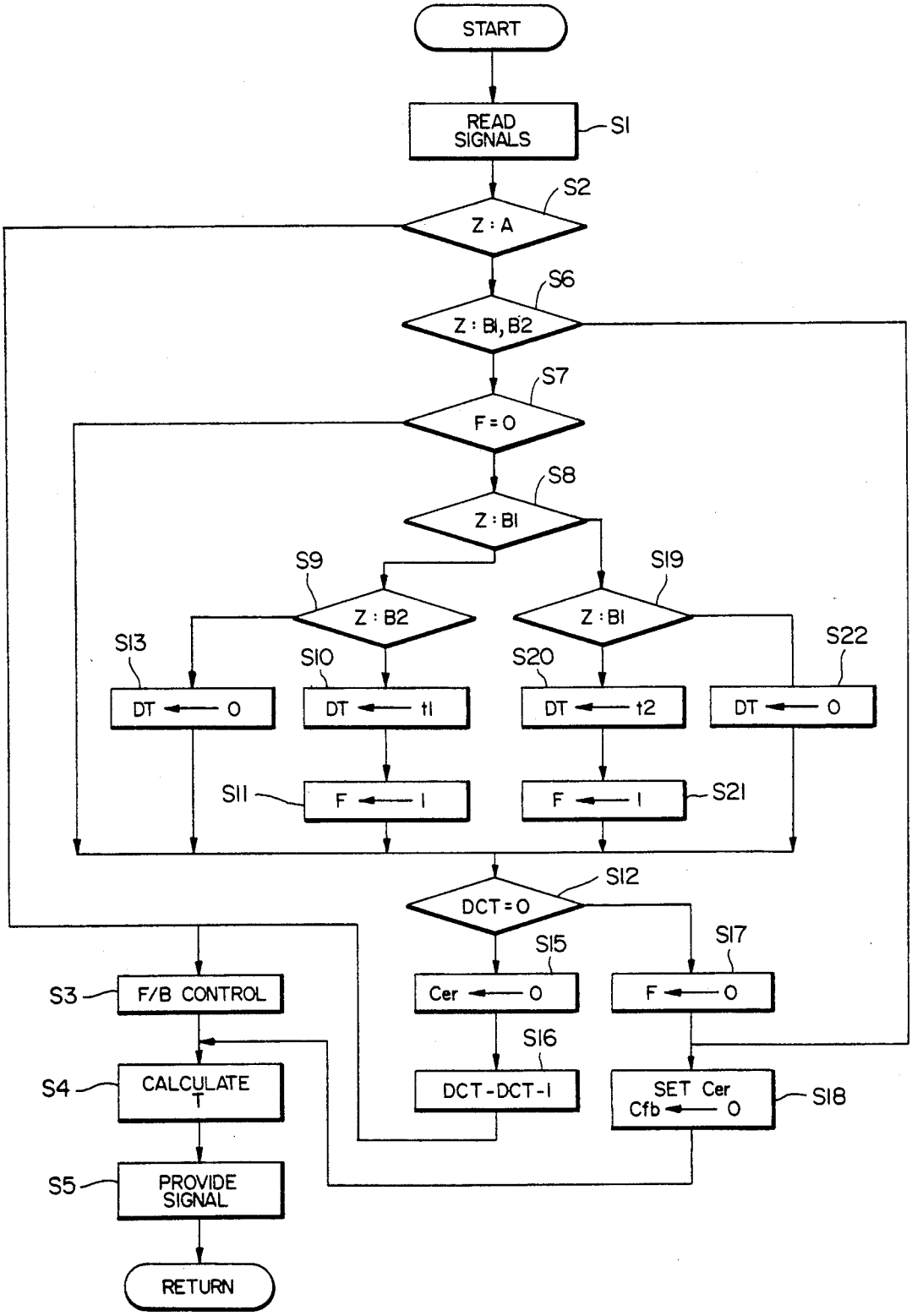
FIG. 3 is a flow chart illustrating a fuel control routine or sequence for a microcomputer.

The operation of the fuel control system depicted in FIG. 1 is best understood by reviewing FIG. 3, which is a flow chart illustrating a fuel injection control sequence for the microcomputer of the control unit 20. Programming a computer is a skill well understood in the art. The following description is written to enable a programmer having ordinary skill in the art to prepare an appropriate program for the microcomputer. The particular details of any such program would, of course, depend upon the architecture of the particular computer selected.

Referring to FIG. 3, it should first be noted that a delay flag F is set to one (1) when a time delayed forced fuel increase control is to be taken, and is reset to zero (0) when no time delayed forced fuel increase control is to be taken. The first step is to read signals from the meter and various sensors in step S1 in order to make a decision in step S2 as to whether the operating condition of the engine is in the low-load fuel feedback (F/B) control zone A, based on the data of the fuel injection control map shown in FIG. 2 and memorized in the microcomputer. If the engine operating condition is in the low-load fuel feedback control zone A, and the answer to the decision in step S2 is yes, a fuel feedback (F/B) control is performed in a well known manner in step S3. In step S3, the fuel increasing correction value Cer is, of course, set to zero. Then, an eventual pulse width (PW) T is calculated according to the above formula (I) in step S4. The control unit 20 provides the fuel injector 14 with a control pulse having the eventual pulse width T to keep it open to deliver a desired amount of fuel depending upon the eventual pulse width T.

On the other hand, if the answer to the decision in step S2 is no, this indicates that the engine operating condition is in the forced fuel increase zone B, namely in either one of the engine speed divisional zones B1, B2 and B3. A decision is then made in step S6 whether the engine operating condition is in either one of the high and low engine speed divisional zones B1 and B2, namely the short time delayed fuel increase control zone or the long time delayed fuel increase control zone. If the answer to the decision in step S6 is yes, a delay flag F is checked to determine whether it has been reset to zero (0) in step S7. If in fact the flag F has been reset, that is the answer in step S7 is yes, a decision is made in step S8 to decide whether the engine operating condition is in the low engine speed divisional zone B1. If yes, in step S9 it is decided whether the engine operating condition was in the high engine speed divisional zone B2 in the last fuel injection control cycle. If the answer to the decision in step S9 is no, this indicates that the engine operating condition was in the lowload fuel feedback zone A in the last fuel injection control cycle and has changed for the first time to the short time delayed fuel increase control zone B1 in the current fuel injection control cycle. Then, after setting a delay time DT to the short delay time t1 for the short time delayed fuel increase control in step S10, the delay flag F is set to one (1) in step S11.

After setting the delay flag F in step S11, a step S12 is taken to decide whether the delay time t1 has elapsed or not. If the answer to the decision in step S12 is no, that is, if the delay time t1 has not lapsed, after cancelling the fuel increasing correction value Cer or setting it to zero (0) in step S15, a delay time counter DCT, which has set itself to an initial value or number, changes the initial number by one decrement. The initial number of the delay time counter DCT is set in order to detect the elapse of delay time DT and, when the delay time DT is set, automatically provided as the quotient obtained by dividing a time necessary to perform one cycle of the fuel injection control routine by the delay time DT. Thereafter, the fuel feedback (F/B) control is performed in steps S3 through S5. The control unit 50 orders return to step S1. After the first cycle of fuel injection control, as long as the engine operating condition stays in the short time delayed fuel increase control zone B1, a "no" answer is provided in step S7. This is because the delay flag F has been set to one (1) in the first cycle. Then, the control unit 20 directly takes step S12, skipping steps S8 to S11. This skipping takes place until the delay time DT has lapsed. When the answer to the decision in step S12 changes to yes, after resetting the delay flag F to zero (0) in step S17, the predetermined fuel increasing correction value Cer is effectively set and the correction value Cfb for feedback fuel control in step S18. After calculating an eventual pulse width (PW) T in step S4, the control unit 20 provides the fuel injector 14 with a control signal representative of the eventual pulse width T to keep it open to deliver a desired amount of fuel depending upon the eventual pulse width T.

If the answer to the decision S9 is yes, this indicates that the engine operating condition was in the long time delayed fuel increase control zone B2 in the last fuel injection control cycle and has changed for the first time to the short time delayed fuel increase control zone B1 in the current fuel injection control cycle and that no time delay is necessary. Then, the delay timer DT is set to zero (0) in step S13. Because of the delay time DT of zero (0), the answer to the decision in step S12 becomes yes. Therefore, after resetting the delay flag F to zero (0) in step S17, the predetermined fuel increasing correction value Cer is set and the correction value Cfb for feedback fuel control is cancelled in step S18. After calculating an eventual pulse width (PW) T in step S4, the control unit 20 provides the fuel injector 14 with a control pulse having the eventual pulse width T to keep it open to deliver a desired amount of fuel depending upon the eventual pulse width T without any time delay.

If the delay flag F has been reset and the answer to the decision in step S8 is no, this indicates that the engine operating condition is in the long time delayed fuel increase control zone B2, and a decision is made in step S19 to decide whether the engine operating condition was in the short time delayed fuel increase control zone B1 in the last fuel injection control cycle. If the answer to the decision in step S19 is no, this indicates that the engine operating condition was in the low load fuel feedback zone A in the last fuel injection control cycle and has changed for the first time to the long time delayed fuel increase control zone B2 in the current fuel injection control cycle. Then, the delay timer DT is set to the delay time t2 for the long time delayed fuel increase control in step S20. After setting the delay flag F to one (1) in step S21, the same steps following step S12 as in the short time delayed fuel increase control zone B1 are taken.

However, if the answer to the decision in step S19 is yes, this indicates that the engine operating condition was in the short time delayed fuel increase control zone B1 in the in the last fuel injection control cycle and has changed for the first time to the long time delayed fuel increase control zone B2 in the current fuel injection control cycle. Then, after setting the delay timer DT to zero (0) in step S22, the same steps following step S12 as in the short time delayed fuel increase control zone B1 are taken.

If the answer to the decision in step S6 is no, this indicates that the engine operating condition is in the real time forced fuel increase control zone B3. Then, the steps S4 and S5 following the step S18 are taken, so as to immediately increase the amount of fuel, without any time delay.

In the above embodiment, during changing to either one of the two time delayed fuel increase control zones B1 and B2 from the low load fuel feedback control zone A, transitionally passing through the other time delayed fuel increase control zone without staying in the other time delayed fuel increase control zone for a time longer than the delay time set for the other time delayed fuel increase control zone, it is possible that the delay time will be set two times: the delay time for the other time delayed fuel increase control zone first and then the delay time for the one time delayed fuel increase control zone. In such a case, it is preferred to cancel the setting of one of the two delay times, in particular, the one for the one time delayed fuel increase control zone.

Figure 4:
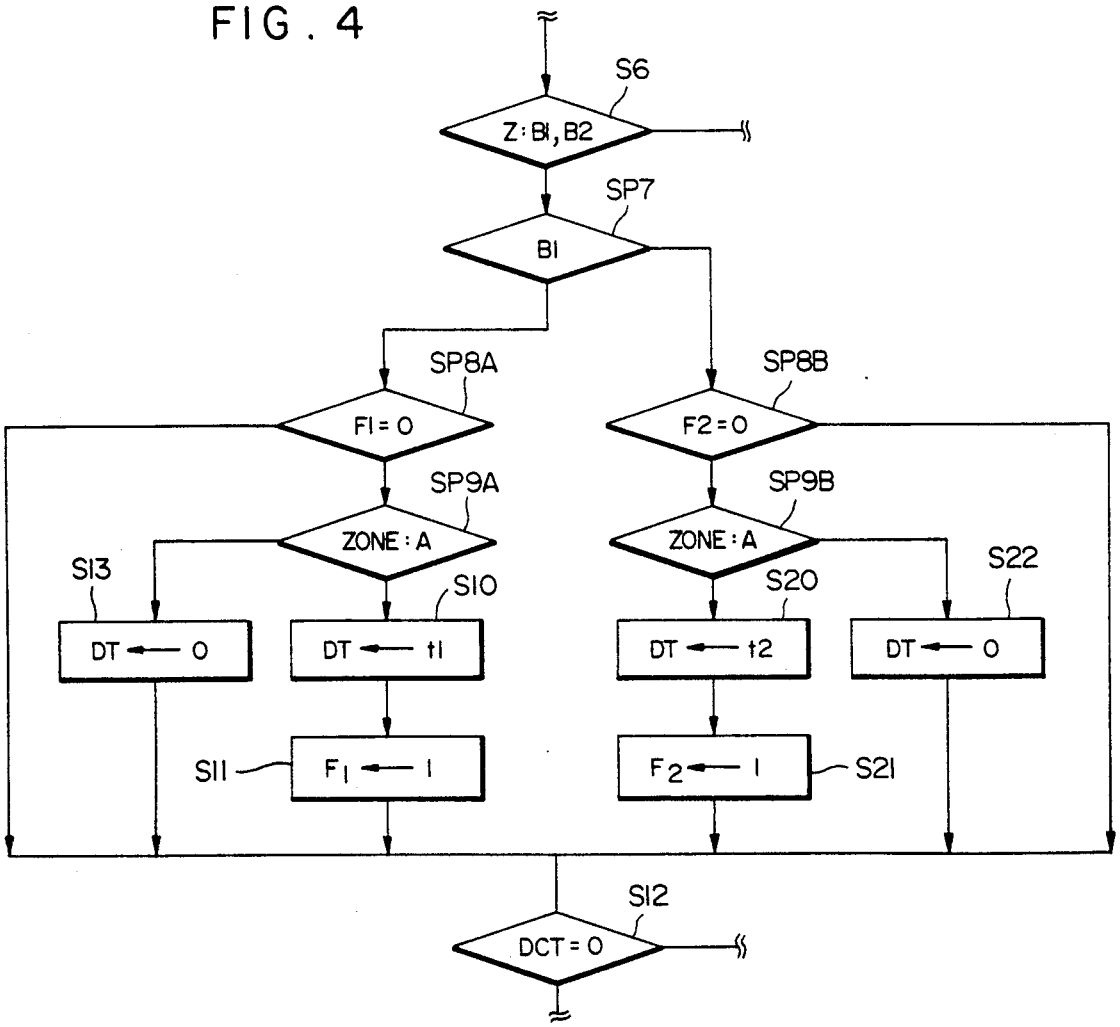
FIG. 4 is a flow chart partly illustrating an alternative to the fuel control routine or sequence of FIG. 2.

Otherwise, in order to set the delay time to one for the transitional time delayed forced fuel increase control zone only, the fuel injection control routine may be modified as is shown in FIG. 4. As shown, when the engine operating condition is neither in the low-load feedback fuel control zone A nor in the real time forced fuel increase control zone B3 (which condition is judged in the decisions in steps S2 and S6 in FIG. 1), after judging in step SP7 a time delayed forced fuel increase control zone in which the engine operating condition falls, a decision is made whether the delay flag has been reset in step SP8A or SP8B. If the answer in step SP7 is yes, the engine operation condition is in the short time delayed forced fuel increase control zone B1, and it is judged in step SP8A whether the delay flag F1 has been reset. If the answer to the decision is yes, another decision is made in step SP9A whether the engine operating condition was in the low-load feedback fuel control zone A during the last fuel injection control cycle. According to the answers to the decision in step SP9A, the delay time DT is set to the short delay time t1 in step S10 or zero (0) in step S13.

On the other hand, if the answer to the decision in step SP7 is no, this indicates that the engine operating condition falls in the long time delayed forced fuel increase control zone B2. It is judged in step SP8B whether the delay flag F2 has been reset. If the answer to the decision is yes, then the same decision as in step SP9A is made in step SP9B whether the engine operating condition was in the low-load feedback fuel control zone A during the last fuel injection control cycle. According to the answers to the decision in step SP9B, the delay time DT is set to the long delay time t2 in step S10 or zero (0) in step S12.

If the answer to the decision in step SP8A or SP8B is no, then, the control unit 20 directly takes step S12, skipping steps following step SP9A or step SP9B. This skipping takes place until the delay time DT has lapsed.

It is to be understood that although the invention has been described in detail with respect to a preferred embodiment, nevertheless various other embodiments and variants are possible which are within the spirit and scope of the invention, and such are intended to be covered by the following claims.

What is claimed is:

1. A fuel control system for an internal combustion engine of an automotive vehicle, comprising:

fuel increasing means for causing a forced increase in an amount fuel so as to enrich an air-fuel mixture to be delivered into said internal combustion engine when an engine operating condition of said internal combustion engine shifts into a specific zone of engine load in which said internal combustion engine operates at high loads; and delay means for delaying said forced increase in an amount of fuel for a -time period from a time of shifting into said specific,zone of engine load, said delay means operative to delay said forced increase when said internal combustion engine changes so as to operate at speeds within a specific zone of engine speed while shifting into said specific zone of engine load, said time period being changed shorter at low speeds in said specific zone of engine speed than at high speeds in said specific zone of engine speed.

2. A fuel control system as defined in claim 1, wherein a fuel injection control is effected in feedback control so as to determine a proper air-fuel ratio by constantly monitoring exhaust to verify the accuracy of an air-fuel mixture setting when an engine operating condition of said internal combustion engine is out of said specific zone of engine load.

3. A fuel control system as defined in claim 2, wherein said forced increase in an amount of fuel is effected in an open-loop control.

4. A fuel control system for an internal combustion engine of an automotive vehicle, comprising:

feedback fuel control means for effecting a feedback fuel control so as to determine a proper air-fuel ratio by constantly monitoring exhaust to verify the accuracy of an air-fuel mixture setting;

fuel increasing means for halting said feedback fuel control and causing a forced increase in an amount of fuel to be delivered into said internal combustion engine so as to enrich said air-fuel mixture setting when an engine operating condition of said internal combustion engine shifts into a specific zone of engine load in which said internal combustion engine operates at high loads;

delaying means for delaying said forced increase in an amount of fuel for a predetermined time period when said internal combustion engine operates at speeds within a specific zone of engine speed in said specific zone of engine load, said time period being changed according to speeds in said specific zone of engine speed.

5. A fuel control system as defined in claim 4, wherein said delaying means is set so that said time period is zero when said internal combustion engine operates at speeds out of said specific zone of engine speed while shifting into said specific zone of engine load.

6. A fuel control system as defined in claim 5, wherein said time period is changed shorter at low speeds in said specific zone of engine speed than at high speeds in said specific zone of engine speed.

7. A fuel control system as defined in claim 5, wherein said specific zone of engine speed is divided into high and low engine speed divisional zones so that said time period is changed to a short time period at speeds in said low engine speed divisional zone and a long time period at speeds in said high engine speed divisional zone.

8. A fuel control system as defined in claim 7, wherein said specific zone of engine speed has an upper extreme of about 4,000 rpm.

9. A fuel control system as defined in claim 7, wherein said low engine speed divisional zone has an upper extreme of 1,000 rpm.

10. A fuel control system as defined in claim 7, wherein said short time period is shorter than approximately three seconds.

11. A fuel control system as defined in claim 7, wherein said long time period is shorter than approximately ten seconds.

12. A fuel control system as defined in claim 7, wherein when an engine operating condition of said internal combustion engine shifts to either one of said high and low engine speed divisional zones, transitionally passing through the other engine speed divisional zone, within a time period established for said the other engine speed divisional zone, a time period for said one engine speed divisional zone is set to zero.

* * * * *